United States Patent [19]

Pietrowski

[11] 4,193,710

[45] Mar. 18, 1980

[54] TRUCK MOUNTED ROLLER

[76] Inventor: Anthony Pietrowski, 509 Superior St., Genoa, Ohio 43430

[21] Appl. No.: 918,066

[22] Filed: Jun. 22, 1978

[51] Int. Cl.[2] ..... E01C 19/26

[52] U.S. Cl. ..... 404/128; 180/79; 180/132; 172/518; 404/86

[58] Field of Search ..... 404/128, 125, 122, 86, 404/130; 180/20, 79.3, 79, 132; 172/518, 554

[56] References Cited

U.S. PATENT DOCUMENTS

| | | | |
|---|---|---|---|
| 1,070,198 | 8/1913 | Stevens et al. | 404/128 X |
| 2,386,025 | 10/1945 | Wills | 404/128 X |
| 2,830,511 | 4/1958 | Wills | 404/128 X |
| 2,925,759 | 2/1960 | Hillis | 404/122 |
| 3,071,051 | 1/1963 | Martin | 404/128 |
| 3,477,535 | 11/1969 | Wyatt | 180/20 |
| 3,665,823 | 5/1972 | Chaney | 404/128 |
| 3,873,228 | 3/1975 | Dunham | 404/128 |
| 3,895,880 | 7/1975 | Fink | 404/128 X |

*Primary Examiner*—Nile C. Byers, Jr.
*Attorney, Agent, or Firm*—Oliver E. Todd, Jr.

[57] ABSTRACT

The present invention is a self-transportable truck mounted roller for paving or repairing paved roads. The invention comprises a lightweight roller and roller assembly mounted to the front end of a truck, and includes hydraulic cylinders or other means for raising and lowering the roller. In operation, the roller is lowered enough to displace the weight of the truck from the front wheels onto the roller, thereby providing a highly compressive paving force.

2 Claims, 6 Drawing Figures

TRUCK MOUNTED ROLLER

BACKGROUND OF THE INVENTION

The present invention relates to apparatus and means for the construction or repair of paved roads, especially the asphalt type. Typically, such roads are surfaced by applying a mixture of asphalt with sand or gravel and then compressing the mixture into place.

New roads are generally compressed and smoothed through the use of steamrollers, but such steamrollers have no integral means for driving to and from a job site, rather they must be transported upon a larger vehicle. Because of the transport disadvantage, time and expense, repairs in roads, especially those of a minor nature such as potholes, often are made without the assistance of steamrollers. In such cases, the asphalt mixture is manually tamped into place and reliance is placed upon normal traffic to further compress and smooth the area of repair. Although certainly more expedient and less expensive than steamrolling, manual tamping results in an inferior and usually temporary patch.

SUMMARY OF THE INVENTION

The present invention is a road-rolling machine which addresses and solves the above-described problems associated with conventional paving equipment and methods.

The machine includes a truck and a front end mounted roller assembly consisting essentially of a cylindrical roller and a roller support structure. The support structure is fixed to the front end of the truck and attaches to both ends of the roller such that the roller is revolvable about its own axis. Hydraulic cylinders or other suitable means, integral with the support structure, raise or lower the roller relative to the truck's front end such that at least a portion of the front end truck weight is transferred to the roller when the roller is lowered, and the entire front end is weighted upon the front wheels of the truck when the roller is raised. The truck may be driven with the roller down such that the weight of the truck is used to press the roller against the pavement.

Thus, the roller may be hollow or otherwise lightweighted, although rigid, which enables the truck to easily transport the roller assembly from job site to job site without the necessity of both a transport truck and a weighty steamroller. The roller assembly may be designed for interchangeability with plows on snow removal trucks, thereby increasing the usefulness of such vehicles.

It is, therefore, an object of the present invention to provide a self-transportable vehicle for use in paving roads.

It is also an object of the present invention to improve the quality of road repair.

It is further an object of the present invention to increase the utility of snow removal trucks.

Other objects and advantages will be obvious to persons skilled in the art from the detailed description of the invention set forth below.

DETAILED DESCRIPTION OF THE INVENTION

Figure 1:
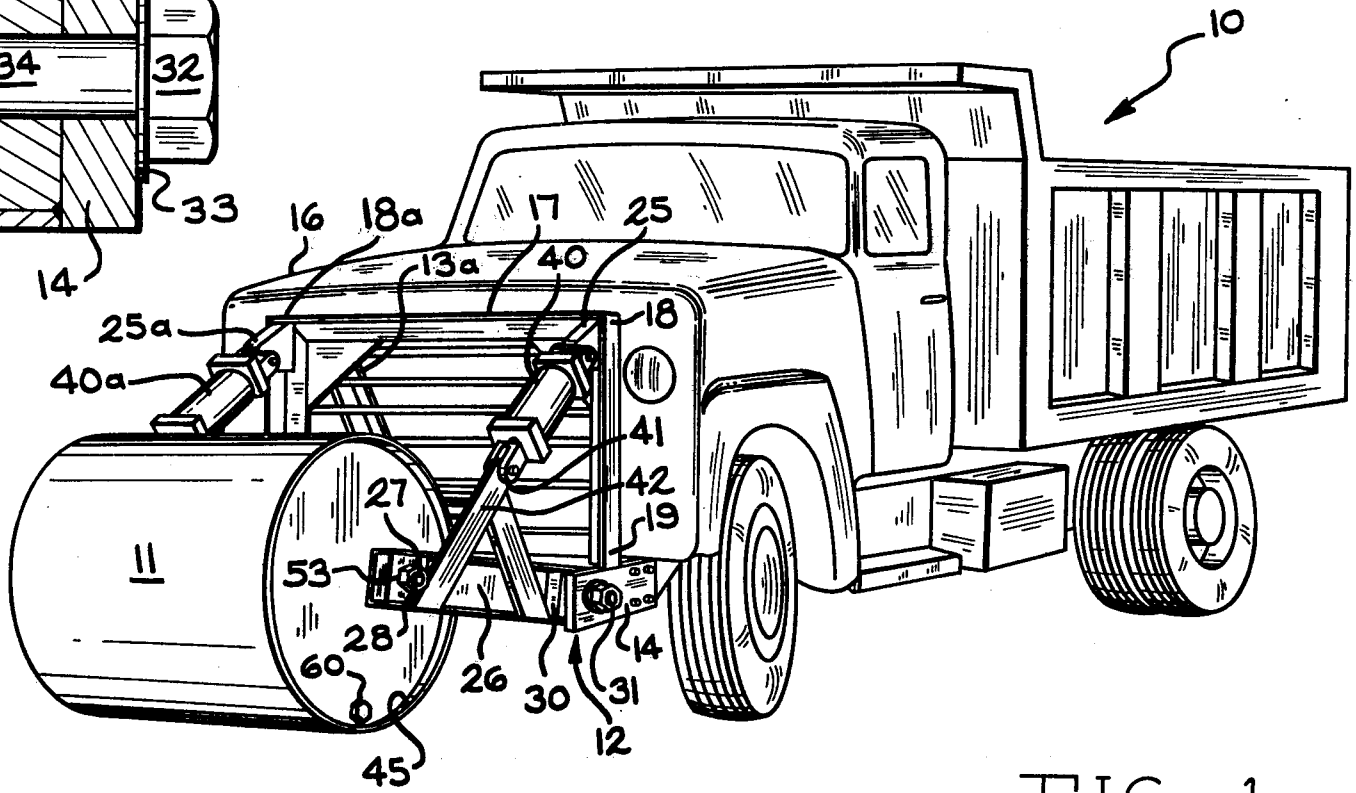
FIG. 1 is an overall perspective view of a preferred embodiment for the road-rolling machine in accordance with the present invention.

FIG. 1 is an overall view of a road-rolling machine, in accordance with the present invention, including a truck 10, a cylindrical roller 11, and a roller support structure 12. Although the truck 10 shown is of the dump type, typically used in cities for snow removal and salt application and for road repair work, no particular type is critical. It is only essential that the particular truck be capable of bearing the loads created by the roller 11 and support structure 12 as described more fully below. Snow removal type trucks are advantageous in that such trucks already have much of the necessary framework and hydraulics for useful employment with the roller 11 and support structure 12 of the present invention. Thus, the present invention provides a means for more efficient year-round utilization of city work trucks.

Figure 2:
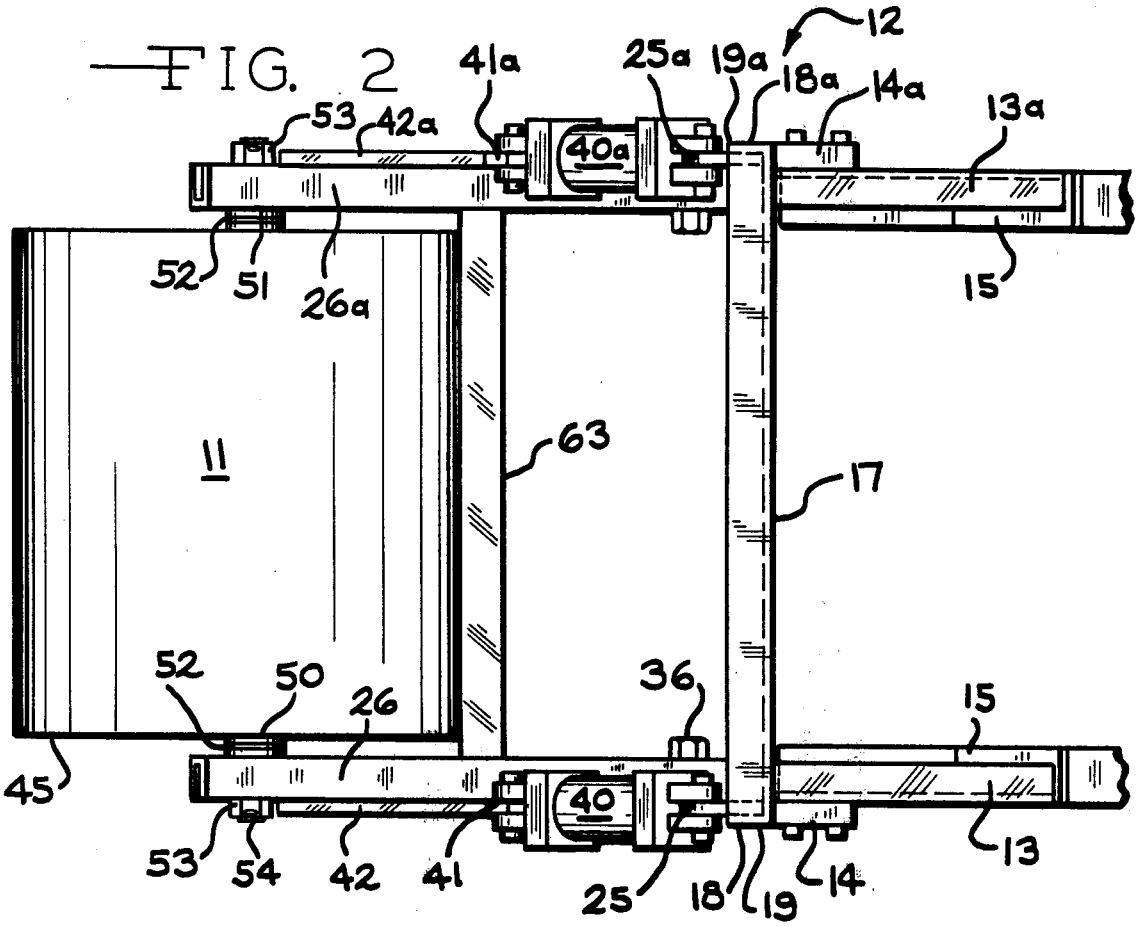
FIG. 2 is a partial top view of the road-rolling machine shown in FIG. 1.
Figure 3:
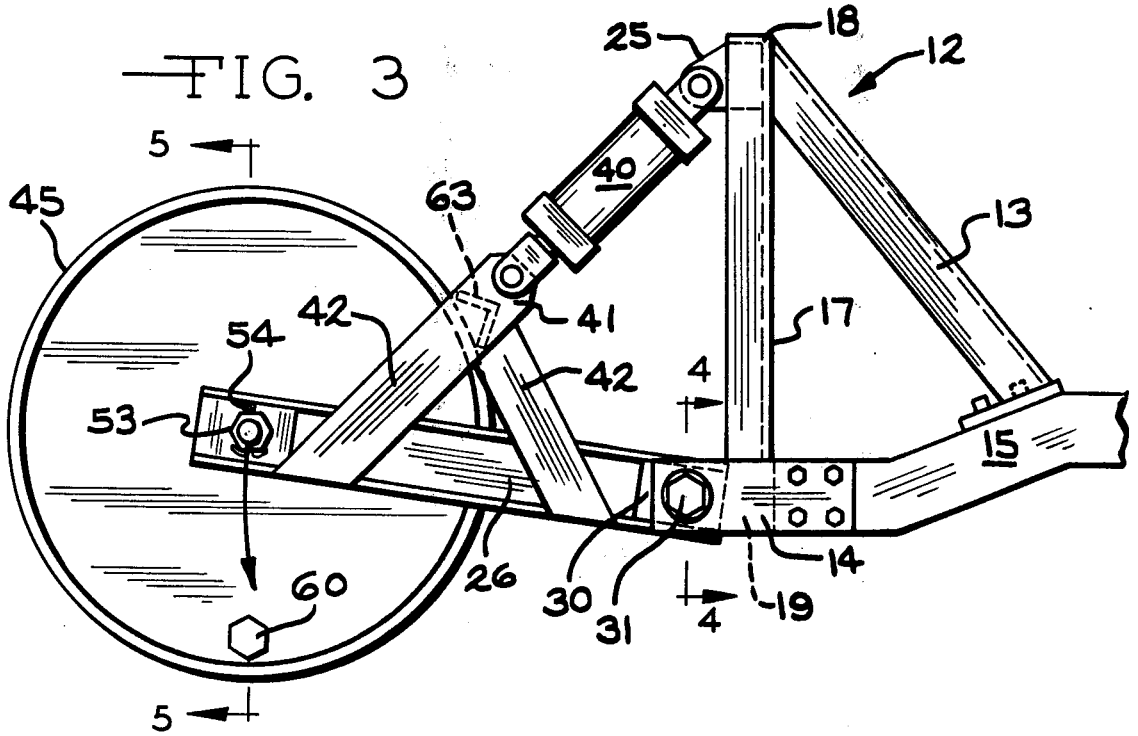
FIG. 3 is a partial side view of the road-rolling machine in FIG. 1.

The roller support structure 12, shown in greater detail in FIGS. 2 and 3, includes truss beams 13 and **13*a* and braces 14 and 14*a* which are attached to the truck frame 15 at the front end 16 and on each side of the truck 10, and which bear the loads during rolling. Additional reinforcement and integration of the structure 12 is provided by a U-shaped angle iron framework 17, the corners 18 and 18*a* of which are joined to the truss beams 13 and 13*a* and the ends 19 and 19*a* of which are joined to the braces 14 and 14*a***.

Flanges 25 and **25*a* at the corners 18 and 18*a* and the braces 14 and 14*a* at the ends 19 and 19*a* of the framework 17 project forwardly therefrom, thereby supplying places for attachment of the rest of the support structure 12**.

Figure 4:
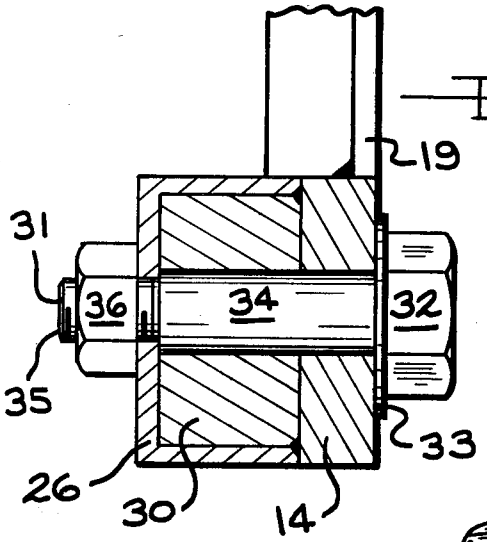
FIG. 4 is a sectional view of a support bearing for the roller along lines 4—4 in FIG. 3.

The roller 11 is coupled to the support structure 12 by means of two C-shaped channel arms 26 and **26*a* extending between and joined to each brace 14 and 14*a* and the ends 27 and 27*a* of an axle 28 for the roller 11. The assembly of one of the arms 26 to its coupled brace 14 is shown in sectional view in FIG. 4. A load bearing 30 within the arm 26 and the arm 26 itself are linked to the brace 14 by means of a shoulder bolt 31. The shoulder bolt 31 includes a head 32, a washer 33, a journal 34 which extends through the brace 14 and the bearing 30 and abuts the arm 26 to prevent excessive tightening, and a threaded portion 35 which is passed through the arm 26 and secured by a nut 36. By means of this arrangement, the arm 26 and load bearing 30 are capable of pivoting about the journal 34 and sliding relative to the brace 14**, for the purposes explained hereafter.

Two-way hydraulic cylinders 40 and **40*a* extend between and are attached in pivotal engagement to each flange 25 and 25*a* and to apexes 41 and 41*a* of triangular trusses 42 and 42*a* which in turn are rigidly secured to the arms 26 and 26*a*. The function of the cylinders 40 and 40*a* is to pivot the arms 26 and 26*a* in the bearing 30, thereby raising and lowering the roller 11. Controls for and the operation of such hydraulic cylinders are well known to persons skilled in the art. Additionally, since the means for raising and lowering the roller 11 is not critical to the present invention, the arms 26 and 26***a* may be pivoted by an electric motor, by pneumatic cylinder, manually, or by other commonly known mechanisms.

Figure 5:
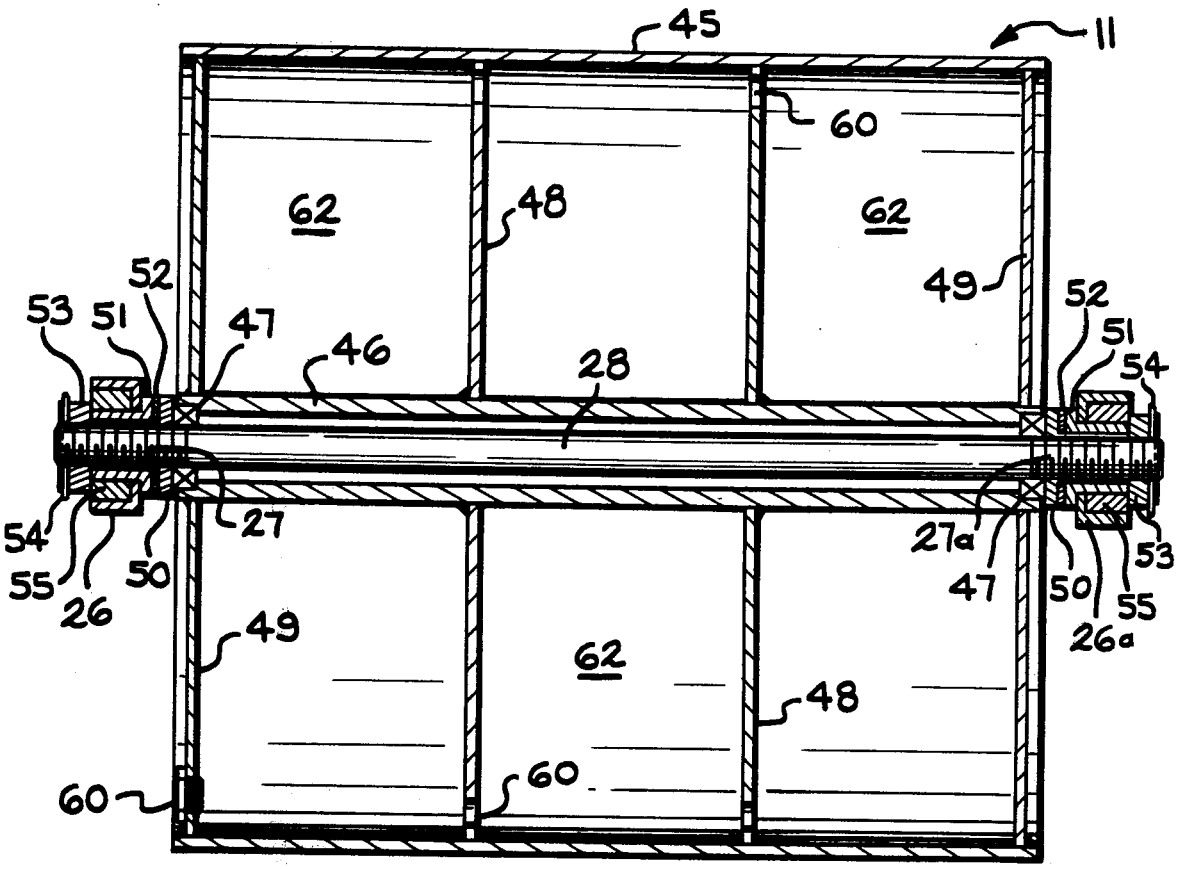
FIG. 5 is a sectional view of the roller along lines 5—5 in FIG. 3.

The roller 11, illustrated in sectional detail in FIG. 5, comprises a cylindrical shell 45 integrally affixed on a central shaft 46 which, in turn, is supported about the axle 28 by means of bearings 47, such that the shell 45 and shaft 46 revolve about the axle 28. Structural support for the roller 11 may be supplied by disks 48 secured within the shell 45 and by the end caps 49. If the disks are omitted, it may be necessary necessary to increase the wall thickness of the shell 45 to maintain a desired strength in the roller 11. The threaded ends 27 and 27*a* of the axle 28 are engaged by spacers 50 and 51 and a washer 52 and are secured by castle nuts 53 through which are inserted a cotter pin 54.

In operation, the cylinders 40 and 40*a* lower the arms 26 and 26*a* until the roller 11 contacts the pavement to be repaired, and then continue to extend until the front end of the truck 10 is partially or wholly uplifted and at least a portion of its weight is placed onto the roller 11. Because of the weight transferred from the front wheels of the truck 10 to the roller 11, the roller 11 need not be as heavy as rollers on conventional steamrollers. However, if additional weight should be considered necessary, the roller 11 is provided with a capped inlet 60 in one end cap 49 for filling the roller 11 with water at the job site. Appropriate slots 61 are provided in each of the disks 48 to allow the water to fill each compartment 62 formed by the disks 48 and the end caps 49. The water may then be drained when the truck is to be driven to another job site. Of course, the roller may be designed to allow its being filled by other mediums such as sand.

When the roller 11 is rolled across fresh asphalt or similar paving materials, some of the material may have a tendency to cling to the outer shell 45. A scraper 63 extends from one arm 26 to the other arm 26*a* and closely abuts the roller 11, such that clinging material is ready and continuously removed from the roller 11. The scraper 63 may be spaced, for example, about ¼ inch from the roller 11.

Figure 6:
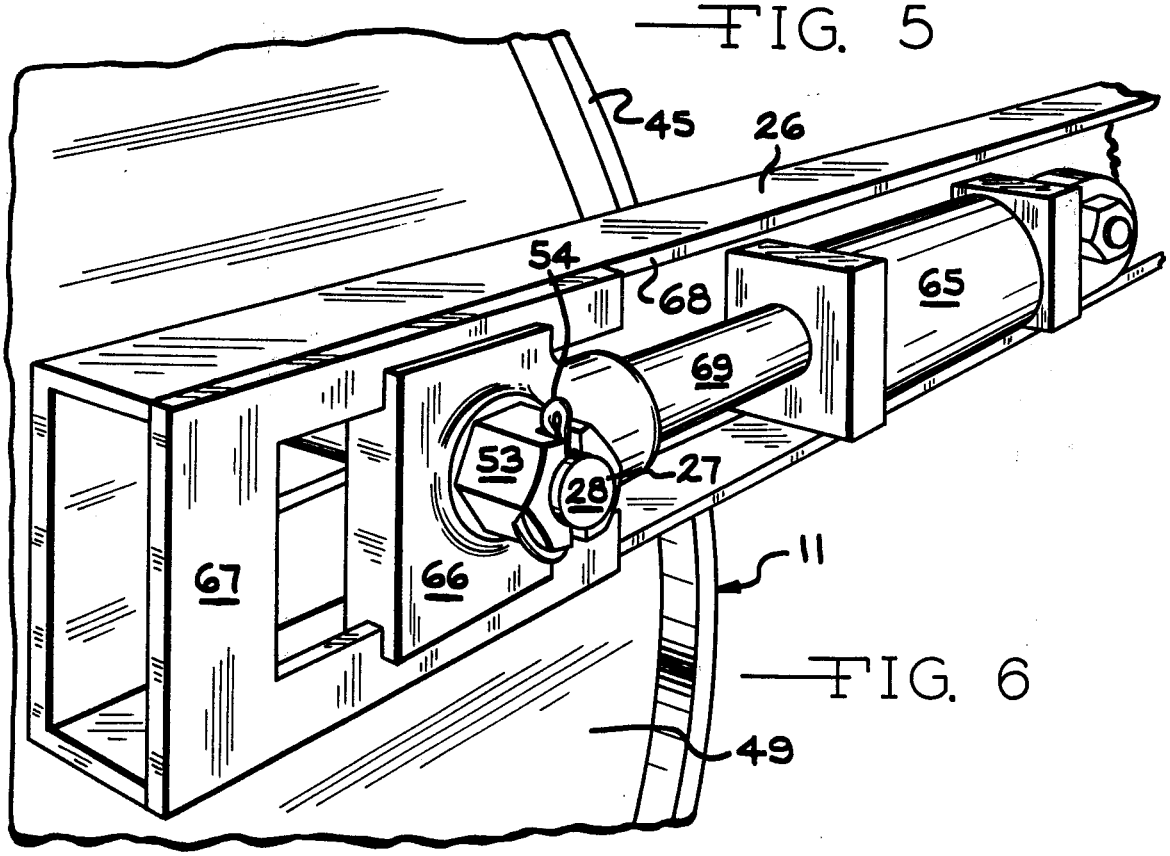
FIG. 6 is a perspective view of an alternate embodiment of a piston/cylinder assembly for steering the roller in a road-rolling machine in accordance with the present invention.

FIG. 6 illustrates a modification to the U-shaped channel arm 26, consisting of a two-way hydraulic cylinder 65 mounted within the arm 26 and terminating with a swivel self-aligning bearing and bearing block 66. The axle 28 extends through the bearing 66, and the bearing 66 abuts and slides along a sloted faceplate 67 across an open face 68 of the arm 26. Thus, as the cylinder's piston 69 is extended, it slides the bearing 66 along the faceplate 67, thereby pivoting the end 27 of the axle 28 and the roller 11 to steer the truck 10 during rolling. A similar arrangement, of course, may be installed on the other arm 26*a* so that the truck 10' may be turned faster in either direction.

While the above description of preferred embodiments of the invention has been provided in great detail, it should be understood that other modifications will be obvious to persons skilled in the art and may be incorporated without departing from the scope of the invention as defined by the following claims.

What I claim is:

1. A road-rolling machine comprising a truck having front wheels and a front end, a roller support structure attached to said truck at said front end, a cylindrical roller having an axis of rotation with two ends, means connecting said roller to said support structure to rotate about said axis with said axis normally extending transverse said truck, said support structure including means for raising and lowering said roller relative to said truck front end such that said front end is weighted at least partially upon said roller when said roller is lowered and upon said front wheels when said roller is raised, and means for driving said truck when said roller is raised or lowered, said support structure including means for shifting only one end of said axis of said roller relative to said truck front end for steering said truck when said roller is in a lowered position.

2. A road-rolling machine, as defined in claim 1, said roller includes at least one internal structural reinforcing member extending diametrically across said roller.

* * * * *